US006722613B1

(12) United States Patent
Phillips et al.

(10) Patent No.: US 6,722,613 B1
(45) Date of Patent: Apr. 20, 2004

(54) KITE HAVING FLAPPING WINGS

(75) Inventors: Douglas E. Phillips, Houston, TX (US); George R. Reneer, Conroe, TX (US)

(73) Assignee: Gayla Industries, Houston, TX (US)

( * ) Notice: Subject to any disclaimer, the term of this patent is extended or adjusted under 35 U.S.C. 154(b) by 0 days.

(21) Appl. No.: 10/317,299

(22) Filed: Dec. 12, 2002

(51) Int. Cl.[7] ..... B04C 31/06
(52) U.S. Cl. ..... 244/153 R; 244/153 A
(58) Field of Search ..... 244/153 R, 154, 244/153 A, 900, 901; D21/445

(56) References Cited

U.S. PATENT DOCUMENTS

| | | | | | |
|---|---|---|---|---|---|
| 743,301 | A | * | 11/1903 | Lischtiak | 244/153 R |
| 919,436 | A | * | 4/1909 | Jackson | 244/153 R |
| 2,394,366 | A | * | 2/1946 | Chu et al. | 244/153 R |
| 2,419,441 | A | * | 4/1947 | De Roda | 244/153 R |
| 2,434,077 | A | * | 1/1948 | Lang | 244/153 R |
| 2,442,417 | A | * | 6/1948 | Lang | 244/153 R |
| 2,762,590 | A | * | 9/1956 | Huie | 244/153 R |
| 3,074,672 | A | * | 1/1963 | Hanrahan, Jr. | 244/153 R |
| 3,116,902 | A | * | 1/1964 | Gould | 244/153 R |
| 3,335,984 | A | * | 8/1967 | Holland, Jr. | 244/153 R |
| 3,534,932 | A | | 10/1970 | Christoffel et al. | 244/153 |
| 3,687,402 | A | | 8/1972 | Christoffel et al. | 244/153 |
| 3,746,286 | A | | 7/1973 | Chrisoffel | 244/155 |
| 3,967,798 | A | | 7/1976 | Christoffel, Jr. | 244/153 |
| 4,026,504 | A | | 5/1977 | Christoffel, Jr. | 244/155 |
| 4,277,040 | A | | 7/1981 | Christoffel, Jr. | 244/153 |
| 4,377,265 | A | * | 3/1983 | Takami et al. | 244/153 R |
| 4,457,478 | A | | 7/1984 | Christoffel, Jr. et al. | 244/155 |
| 4,530,477 | A | * | 7/1985 | Ito et al. | 244/153 R |
| 4,557,443 | A | | 12/1985 | Christoffel, Jr. | 244/153 |
| 4,634,085 | A | * | 1/1987 | Cuesta et al. | 244/153 R |
| 4,969,615 | A | * | 11/1990 | Gellert | 244/153 R |
| 6,357,697 | B1 | | 3/2002 | Wu | 244/153 |

OTHER PUBLICATIONS

"Wildlife™Kite Assembly Instructions" by Gayla Industries, Inc., undated, 1 page.
"Assembly Instructions for Gayla Sunt Master™" by Gayla Industires, Inc., ©1997, 2–pages.
"Ultraflite©Assembly Instructions"by Gayla Industries, Inc., ©1988, 2–pages.
"343 Thunder Birds™and 342 Blue Angel™Assembly Instructions" by Gayla Industries, Inc., Mar. 18, 1999, 1–page.
"Gayla Tri–Plane Kite Assembly Instructions" by Gayla Industries, Inc., May 31, 2001, 1–page.

* cited by examiner

*Primary Examiner*—Charles T. Jordan
*Assistant Examiner*—T. Nguyen
(74) *Attorney, Agent, or Firm*—Howrey Simon Arnold & White LLP

(57) ABSTRACT

A kite is disclosed having a body and a supporting structure. The supporting structure has a central member, wing members, cross members, and a brace member. The central member is attached to the body such that the body has first and second wing portions on either side of the central member. The wing members are attached to each wing portion and are oriented substantially perpendicular to the central member. The cross members respectively support the wing members to the central member. First ends respectively couple to one of the wing members, intermediate portions cross one another and are held adjacent the central member, and second ends couple to the body. The brace member is capable of biasing the wing members apart. Ends of the brace member respectively couple to the wing members, and an intermediate portion is held adjacent the central member.

27 Claims, 4 Drawing Sheets

KITE HAVING FLAPPING WINGS

FIELD OF THE INVENTION

The present invention relates generally to a kite and, more particularly to a kite having wing portions capable of flapping during flight.

BACKGROUND OF THE INVENTION

Various styles of kites, such as kites having keels or acrobatic kites, are known in the art. As disclosed in U.S. Pat. No. 3,687,402, for example, a typical kite having a keel includes a "delta" shape having a flat body supported by a central rod, angled rods, and a rigid cross rod. The central rod is attached to the body. The two, angled rods are also attached to the body and are oriented at acute angles with respect to the central rod. The rigid cross rod is connected between the acute angled rods. The supporting structure of the typical kite having a keel limits the possible shapes that can be used for the kite. Furthermore, wing portions of typical kites having keels are substantially constrained and are, therefore, incapable of significant flapping during flight.

The present invention is directed to overcoming, or at least reducing the effects of, one or more of the problems set forth above.

SUMMARY OF THE INVENTION

A kite is disclosed having a body and a supporting structure. The body has first and second edges. The supporting structure has a central member, first and second wing members, first and second cross members, and a brace member. The central member is attached to the body such that the body has first and second wing portions on either side of the central member. The wing members are attached to the body on either side of the central member. Preferably, the wing members are orientated at an approximately perpendicular angle with respect to the central member. The cross members each have first and second ends and an intermediate portion. The first ends are respectively coupled to one of the wing members. The second ends are coupled to the body adjacent the second edge. The intermediate portions of the cross members are held adjacent the central member and preferably cross one another at a substantially equivalent point on the central member. The brace member is capable of biasing the first and second wing members apart. The brace member has first and second ends and an intermediate portion. The first and second ends are respectively coupled to the first and second wing members. The intermediate portion is held adjacent the central member. During operation, the supporting structure maintains structural integrity allowing the disclosed kite to fly yet allowing the wing portions of the disclosed kite on either side of the central member to flap.

The foregoing summary is not intended to summarize each potential embodiment or every aspect of the invention disclosed herein.

BRIEF DESCRIPTION OF THE DRAWINGS

The foregoing summary, a preferred embodiment, and other aspects of the present invention will be best understood with reference to a detailed description of specific embodiments of the invention, which follows, when read in conjunction with the accompanying drawings, in which.

Figure 1:
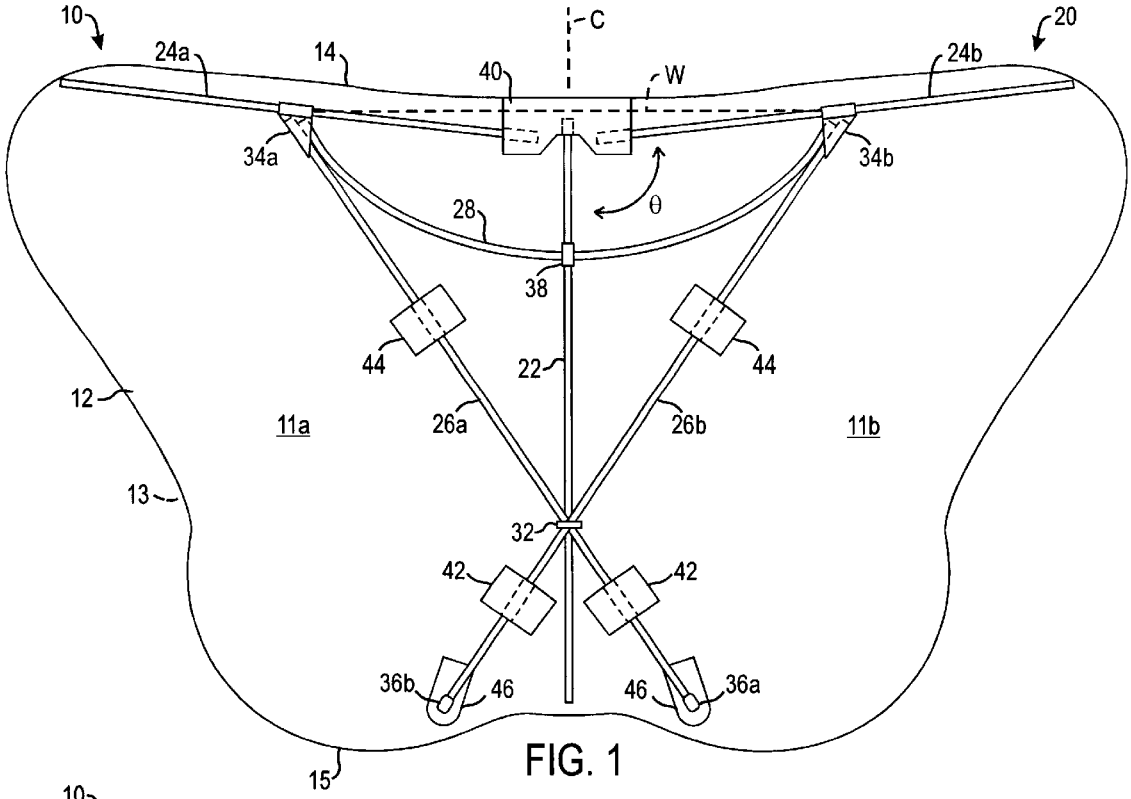
FIG. 1 illustrates a plan view of a first side of an embodiment of a kite according to the present invention.

While the disclosed kite is susceptible to various modifications and alternative forms, specific embodiments thereof have been shown by way of example in the drawings and are herein described in detail. The figures and written description are not intended to limit the scope of the invention in any manner, rather they are provided to illustrate the invention to a person of ordinary skill in the art by reference to particular embodiments of the disclosed kite, as required by 35 U.S.C. § 112.

DETAILED DESCRIPTION OF THE INVENTION

Figure 2:
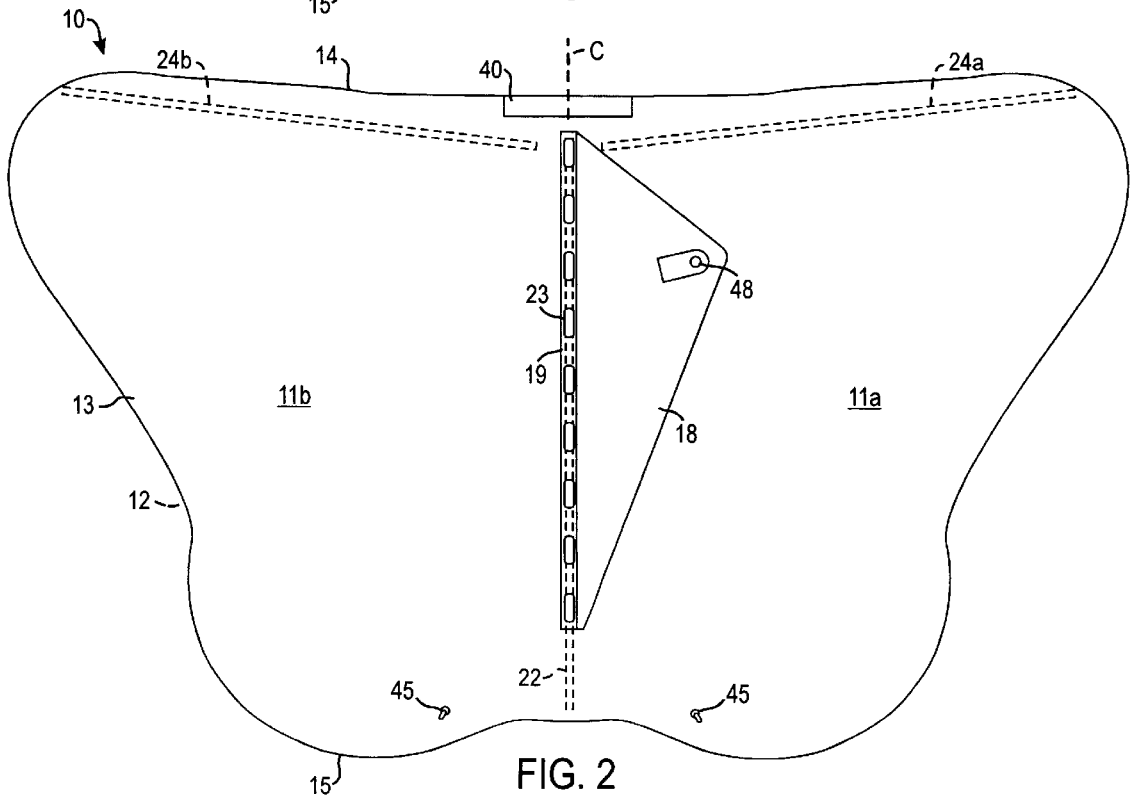
FIG. 2 illustrates a plan view of a second side of the disclosed kite of FIG. 1.

Referring to FIGS. 1 and 2, a kite according to the present invention is illustrated in first and second plan views. The disclosed kite includes a body 10 and a supporting structure 20. The body 10 has first and second sides 12 and 13 and first and second edges 14 and 15. As best shown in FIG. 2, the second side 13 of the body 10 has a keel member 18 attached thereto for attaching to a string (not shown). To achieve lift during flight, the second side 13 is intended to be the high pressure side of the disclosed kite, and the first side 12 is intended to be the low pressure side. In addition, the first edge 14 is intended to be the leading edge of the disclosed kite.

The body 10 can have any desirable aesthetic shape and can be composed of a sheet of plastic or any other material known in the art. As illustrated, the first edge 14 can define a greater width than the second edge 15, which is unconventional for typical kites having keels or acrobatic kites known in the art. In the present example, the body 10 has the shape of an insect, such as a butterfly.

As best shown in FIG. 1, the supporting structure 20 includes a central member 22, first and second wing members 24*a–b*, first and second cross members 26*a–b*, and a brace member 28. The central member 22 is attached to the first side 12 of the body 10 with a first end adjacent the first edge 14 and with a second end adjacent the second edge 15. Accordingly, the central member 22 divides the body 10 along a central axis C into wing portions 11*a–b* on either side of the central member 22.

The first and second wing member 24*a–b* are attached on opposite wing portions 11*a–b*. In particular, the first wing member 24*a* is attached to the first side 12 of the body 10 substantially along a first portion of the first edge 14. The second wing member 24*b* is attached to the first side 12 of the body 10 substantially along a second portion of the first edge 14. The wing members 24*a–b* are preferably oriented at substantially perpendicular angles with respect to the central member 22.

As is known in the art of kite design, the body 10 and structure 20 are preferably symmetrical about the central axis C and preferably lightweight. Furthermore, the body 10 and structure 20 preferably do not have excessive amounts of weight substantially near the edges 14 and 15, which could cause the kite to dip or become unbalanced during flight. The central member 22 and the wing members 24*a–b* are preferably rods composed of extruded plastic, such as styrene. The central member 22 and the wing members 24*a–b* are preferably rectilinear in cross-section and are preferably hollow to reduce weight and enhance strength. The central member 22 and the wing members 24*a–b* can be attached to the body 10 by methods known in the art, such as by adhesive bonding, heat bonding, mechanical bonding or combinations thereof.

As best shown in FIG. 2, the keel member 18 has an attachment portion 19 that is attached to the body 10 substantially at the location of the central member 22. The body 10 preferably has holes 23, and the attachment portion 19 of the keel member 18 is preferably attached to the body 10 and central member 22 by a technique disclosed in U.S. Pat, No. 3,687,402, which is owned by the Assignee of record and is incorporated herein by reference.

The cross members 26*a–b* and brace member 28 are preferably composed of extruded plastic, such as styrene. The cross members 26*a–b* and brace member 28 are preferably cylindrical and flexible. Moreover, the cross members 26*a–b* and brace member 28 are preferably hollow to reduce weight and enhance strength.

As best shown in FIG. 1, the first cross member 26*a* substantially supports the first wing member 24*a* to the cross member 22 and extends across the central member 22 substantially from the first edge 14 of the body 10 to the second edge 15. The first cross member 26*a* has a first portion or end, a second portion or end, and a third or intermediate portion. The first end of the cross member 26*a* is held adjacent the first wing member 24*a* at 34*a*. Preferably, a first coupling member is attached to the first wing member 24*a* at 34*a* and couples to the first end when assembling the disclosed kite. A number of structures, coupling members, or strut connectors known in the art can be used to couple the cross member 26*a* to the wing member 24*a*. A preferred embodiment of a coupling member is disclosed below with reference to FIGS. 3A–B.

The second end of the first cross member 26*a* is held adjacent the body 10 at 36*a*. Preferably, when assembling the disclosed kite, a first end member at 36*a* attaches to the second end of the cross member 26*a* and couples to a reinforced hole 45 (shown in FIG. 2) in the body 10, which is reinforced by a reinforcement tab 46. A number of structures or end members known in the art can be used for connecting the second end of the cross member 26*a* to the body 10. For example, a hook or catch (not shown) can be used on the end of the cross member 26*a* to engage a hole in the body. In another example, the second end of the cross member 26*a* can directly engage a tab (not shown) attached to the body 10. A preferred embodiment of an end member and its method of attaching to the body 10 are disclosed below with reference to FIGS. 4A–B.

The intermediate portion of the first cross member 26*a* is held adjacent the central member 22 at 32. Preferably, a first holding member is attached to the central member 22 at 32 for holding the cross member 26*a*. A number of structures or holding members known in the art can be used for holding the cross member 26*a*. For example, a ring, loop, twist tie, clip, or an affixed tab having a hole can be used to hold the cross member 26*a* adjacent the central member 22. A preferred embodiment of a first holding member is disclosed below with reference to FIGS. 5A–B.

The second cross member 26*b* substantially supports the second wing member 24*b* to the central member 22 and extends across the central member 22 substantially from the first edge 14 of the body 10 to the second edge 15. The second cross member 26*b* has a first portion or end, a second portion or end, and a third or intermediate portion. The first end is held adjacent the second wing member 24*b* at 34*b*. Preferably, a second coupling member is attached to the second wing member 24*b* at 34*b* for coupling to the first end of the second cross member 26*b* when assembling the disclosed kite.

The second end of the second cross member 26*b* is held adjacent the body 10 at 36*b*. Preferably, when assembling the disclosed kite, a second end member at 36*b* attaches to the second end of the cross member 26*b* and couples to a hole 45 (shown in FIG. 2) in the body 10, which is reinforced by a reinforcement tab 46. The intermediate portion of the second cross member 26*b* is held adjacent the central member 22 at 32. Preferably, the same first holding member used to hold the first cross member 26*a* adjacent the central member 22 at 32 is also used to hold the second cross member 26*b*.

The brace member 28 biases the first and second wing members 24*a–b* apart. The brace member 28 has a first portion or end, a second portion or end, and a third or intermediate portion. The first end is held adjacent the first wing member 24*a*, and the second end is held adjacent the second wing member 24*b*. Preferably, the ends of the brace member 28 couple to first and second coupling members that are respectively attached to the wing members 24*a–b* at 34*a–b* and that also couple to the ends of the cross members 26*a–b* as well. As an alternative to the use of single coupling members at 34*a–b* to couple both cross members 26*a–b* and the brace member 28 to the wing members 24*a–b*, separate coupling members can be used to individually couple the cross members 26*a–b* to the wing members 24*a–b* and to individually couple the brace member 28 to the wing members 24*a–b*.

The intermediate portion of the brace member 28 is held adjacent the central member 22 at 38. Preferably, a second holding member is attached to the central member 22 at 38 for holding the brace member 28 adjacent the central member 22. A number of structures or holding members known in the art can be used for holding the brace member 28 adjacent the central member 22. For example, a ring, loop, twist tie, clip, or an affixed tab having a hole can be used to hold the cross member 26*a* adjacent the central member 22. A preferred embodiment of a second holding member is disclosed below with reference to FIGS. 6A–B.

When assembled, the brace member 28 is preferably bent to form an arc as illustrated in FIG. 1 so that the brace member 28 can bias the first and second wing members 24*a–b* apart. As an alternative to the having the brace member 28 form an arc, the brace member 28 can include any rectilinear or curvilinear shape capable of coacting between the wing members 24*a–b* for biasing the members 24*a–b* apart. In addition to the flexibility it has, the brace member 28 is preferably pivotable at 38 so that the ends at 34*a–b* can be moved relative to the central member 22.

In a preferred embodiment of the disclosed kite, the central member 22 is approximately 22-inches in length; the wing members 24*a–b* are each approximately 18-inches in length; and the cross members 26*a–b* are each approximately 27-inches in length. The wing members 24*a–b* are each oriented at an angle θ of about 96 to 97-degrees with respect to the central member 22.

The coupling locations at 34*a–b* are approximately centrally positioned on the wing members 24*a–b*. In addition, the coupling locations 34*a–b* are spaced approximately 21-inches apart along a line W being perpendicular to the central axis C of the central member 22 so that each coupling location 34*a–b* is spaced approximately 10.5-inches from the central axis C of the disclosed kite. The second holding member 38 is distanced approximately 5.5-inches from the line W or approximately 5-inches from the first end of the central member 22. The first holding member 32 is distanced approximately 6.25-inches from the second end of the central member 22 and approximately 10.75-inches from the first holding member 32. The end members at 36*a–b* are spaced approximately 9-inches apart across the central axis C. The dimensions disclosed above have been found to provide suitable structural integrity for the disclosed kite and to allow for flapping of the wing portions 11*a–b* during flight. One of ordinary skill in the art, however, will appreciate that the dimensions provided herein are only exemplary and can be altered depending on the particular implementation of the disclosed kite.

Figure 3A:
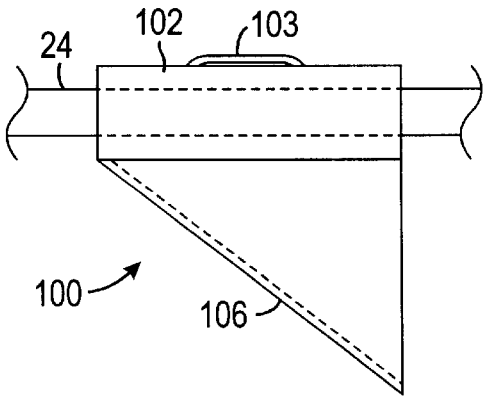
FIGS. 3A–B respectively illustrate a side view and an end view of a preferred embodiment of a coupling member for the disclosed kite.
Figure 3B:
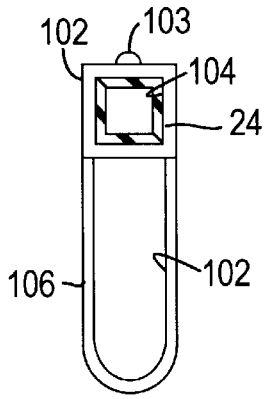

As noted above with reference to FIG. 1, coupling members are preferably used at 34*a–b* to couple the ends of the cross members 26*a–b* and brace member 28 to the wing members 24*a–b*. Referring to FIGS. 3A–B, a preferred embodiment of a coupling member 100 is illustrated in a side view and an end view, respectively. The preferred coupling member 100 is capable of coupling to both an end of a cross member (not shown) and an end of a brace member (not shown).

The preferred coupling member 100 substantially resembles a strut connector disclosed in U.S. Pat. No. 3,534,932, which is incorporated herein by reference. The preferred coupling member 100 includes an attachment portion 102 and a cup portion 106. As best shown in FIG. 3B, the attachment member 102 defines a bore 104 through which the wing member 24 is positioned. The wing member 24 can be a rod having a rectilinear cross-section so that the bore 104 can also be rectilinear. The attachment member 102 is attached to the wing member 24 using methods known in the art, such as a staple 103. The cup portion 106 defines an angled opening 108 for receiving the ends of the cross member and the brace member. As an alternative to the use of the coupling member 100, other strut connectors known in the art can be used, such as those disclosed in U.S. Pat. Nos. 4,277,040 and 4,557,443, which are owned by the Assignee of record and incorporated herein by reference.

Figure 4A:
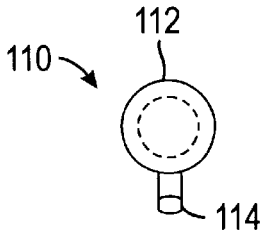
FIGS. 4A–B respectively illustrate a side view and an end view of a preferred embodiment of an end member for the disclosed kite.
Figure 4B:
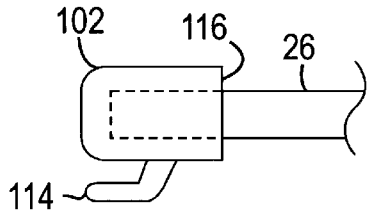

As noted above with reference to FIG. 1, end members are preferably used at 36*a–b* to attach ends of the cross members 26*a–b* to the body 10. Referring to FIGS. 4A–B, a preferred embodiment of an end member 110 is illustrated in a side view and an end view, respectively. The preferred end member 110 includes an attachment portion 112 and a hook portion 114. The attachment portion 112 defines an open end 116 for receiving an end of a cross member 26, which is preferably cylindrical. The hook portion 114 is oriented away from the direction of the cross member 26 and is intended to catch in a reinforced hole in the body, which is shown as element 45 in FIG. 2.

Figure 5A:
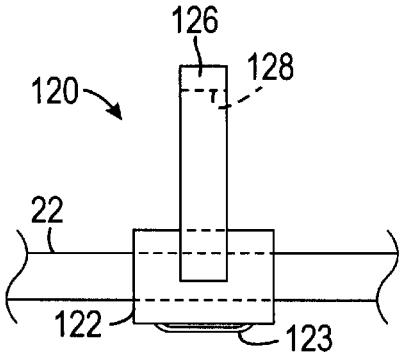
FIGS. 5A–B respectively illustrate a side view and an end view of a preferred embodiment of a first holding member for the disclosed kite.
Figure 5B:
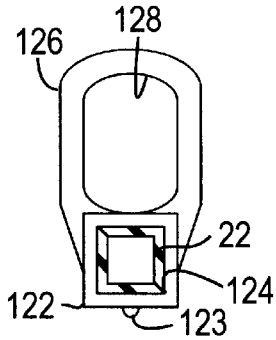

As noted above with reference to FIG. 1, a first holding member is preferably used at 32 on the central member 22 for holding the intermediate portions of the cross members 26*a–b* adjacent the central member 22. Referring to FIGS. 5A–B, a preferred embodiment of a first holding member 120 is illustrated in a side view and an end view, respectively. The preferred first holding member 120 includes an attachment portion 122 and a loop portion 126. The attachment portion 122 defines a bore 124 through which the central member 22 is positioned. As shown in FIG. 5B, the central member 22 can be a hollow rod having a rectilinear cross-section so that the bore 124 can also be rectilinear. The attachment portion 122 is attached to the central member 22 using methods known in the art, such as a staple 123. The loop portion 126 defines an elongated opening 128 for passage of both cross members (not shown). As shown in FIG. 5B, the elongated opening 128 can have curved ends for accommodating the preferably cylindrical cross members that pass therethrough.

Figure 6A:
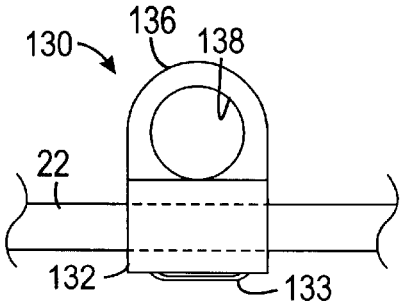
FIGS. 6A–B respectively illustrate a side view and an end view of a preferred embodiment of a second holding member for the disclosed kite.
Figure 6B:
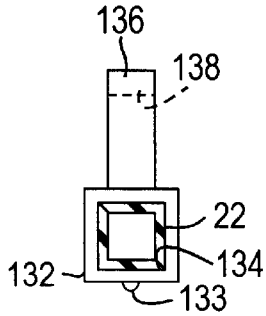

As noted above with reference to FIG. 1, a second holding member is preferably used at 38 on the central member 22 for holding the intermediate portion of the brace member 28 adjacent the central member 22. Referring to FIGS. 6A–B, a preferred embodiment of a second holding member 130 is illustrated in a side view and an end view, respectively. The preferred second holding member 130 includes an attachment portion 132 and a loop portion 136. The attachment member 132 defines a bore 134 through which the central member 22 is positioned. As shown in FIG. 6B, the central member 22 can be a hollow rod having a rectilinear cross-section so that the bore 134 can also be rectilinear. The attachment portion 132 is attached to a central member 22 using methods known in the art, such as a staple 133. The loop portion 136 defines a transverse opening 138 for passage of the brace member (not shown). As shown in FIG. 6A, the transverse opening 138 can be circular for the preferably cylindrical brace member that passes therethrough.

With the benefit of the above structural overview of the disclosed kite, assembly of the disclosed kite will now be discussed with reference to FIGS. 1 and 2. During assembly, the body 10 of the disclosed kite is placed with the second side 13 down so that the central member 22 and the wing members 24*a–b* pre-attached to the first side 12 of the body 10 can be accessed. Distal ends of the cross members 26*a–b* are inserted through the first holding member at 32. The first cross member 26*a* is preferably positioned through the first holding member at 32 so as to be between the second cross member 26*b* and the central member 22. This arrangement helps to provide balance to the disclosed kite. As shown in FIG. 2, the attachment portion 19 of the keel member 18 is attached substantially at the location of the cross member 22 and can be approximately ¼-inch wide. As a result, the keel member 18 is slightly offset from the central axis C of the disclosed kite. Having the second cross member 24*b* position over the first cross member 24*a* at 32 on the cross member 22 helps to provide balance to the disclosed kite, which is needed during flight.

Continuing with the assembly of the disclosed kite, reinforcement tabs 46 are then applied to the first side 12. The tabs 46 have holes (not shown) that are aligned with the preformed holes 45 (shown in FIG. 2) in the body 10. End members are then pushed onto proximal ends of the cross members 26*a–b*, and the cross members 26*a–b* are then spread apart to form an "X" shape. The distal ends of the cross members 26*a–b* are respectively coupled to coupling members at 34*a–b*, and the end members on the cross members 26*a–b* are then attached to the body 10. The brace member 28 is inserted through a second holding member at 38. The brace member 28 is bent to form an arc, and each end of the brace member 28 is coupled to a coupling member at 34*a–b* on the wing members 24*a–b*.

First wing reinforcement tabs 42 are attached to the cross members 26*a–b* and the body 10 and are preferably placed a distance of approximately 5.25-inches from the end members at 36*a–b*. The first wing reinforcement tabs 42 help hold the body 10 to the cross members 26*a–b* near the second edge 15 and can be useful when the disclosed kite is first launched for flight. Similarly, second wing reinforcement tabs 44 are attached to the cross members 26*a–b* and the body 10 and are preferably placed approximately at a center between the first holding member at 32 and the coupling members at 34*a–b*. These tabs 44 can also be beneficial in holding the body 10 to the cross members 26*a–b* when launching.

A top reinforcement tab 40 is attached at the juncture of the central member 22 and the wing members 24*a–b*. As best shown in FIG. 2A, a portion of this top reinforcement tab 40 is folded over the edge 14 and is attached to the second side 13 of the body 10. The top reinforcement tab 40 helps to prevent tearing of the body 10 at the edge 14, which can be caused by the biasing of the brace member 28, for example. Finally, a string (not shown) is tied to a reinforced hole 48 in the keel member 18.

Figure 7:
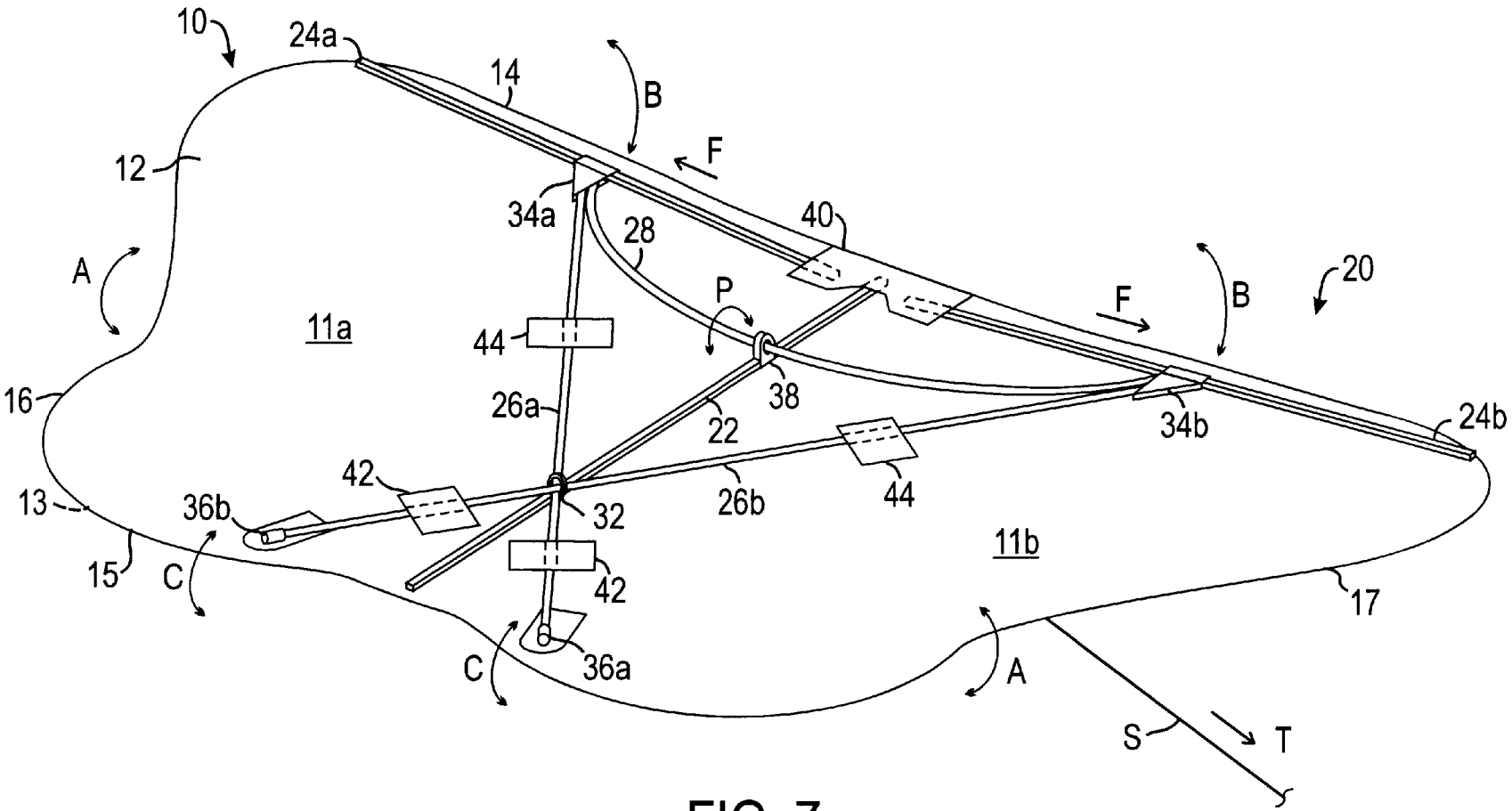
FIG. 7 illustrates a perspective view of the disclosed kite.

With the benefit of the above structural overview and assembly of the disclosed kite, operation of the disclosed kite will now be discussed. Referring to FIG. 7, the disclosed kite is illustrated in a perspective view showing the first side 12 of the body 10 having the supporting structure 20. The keel (not shown) is attached to a string S having tension T. To achieve lift during flight, the second side 13 is intended to be the high pressure side of the disclosed kite, and the first side 12 is intended to be the low pressure side of the disclosed kite. The first edge 14 is intended as the leading edge of the disclosed kite.

During flight, the supporting structure 20 maintains structural integrity of the disclosed kite yet allows the wing portions 11*a–b* of the disclosed kite on either side of the central member 22 to flap. For example, the wing portions 11*a–b* are capable of flapping in directions A during flight. Flapping can be caused by changes in airflow around the body 10 or by varying the tension T on the string S. In one aspect, the substantially unconstrained third and fourth edges 16 and 17 of the body 10 allow the wing portions 11*a–b* to flap in directions A. The edges 16 and 17 lack structural members attached thereto and are, therefore, free to flutter during flight.

In another aspect, the cross members 26*a–b* and the brace member 28 of the supporting structure 20 being flexible and moveable relative to one another also allow for flapping of the wing portions 11*a–b* in directions A. Although supported to the central member 22 by the cross members 26*a–b*, the wing members 24*a–b* can move in directions B due to the possible pivoting in direction P and the possible flexing of the brace member 28. The wing members 24*a–b* can also move in directions B due to the possible flexing of the cross members 26*a–b* between the holding member at 32 and the coupling members at 34*a–b*. In addition, the wing portions 11*a–b* near the second edge 15 can move in directions C due to the possible flexing of the cross-members 26*a–b* between the first holding member at 32 and the end members at 36*a–b*.

Figure 8:
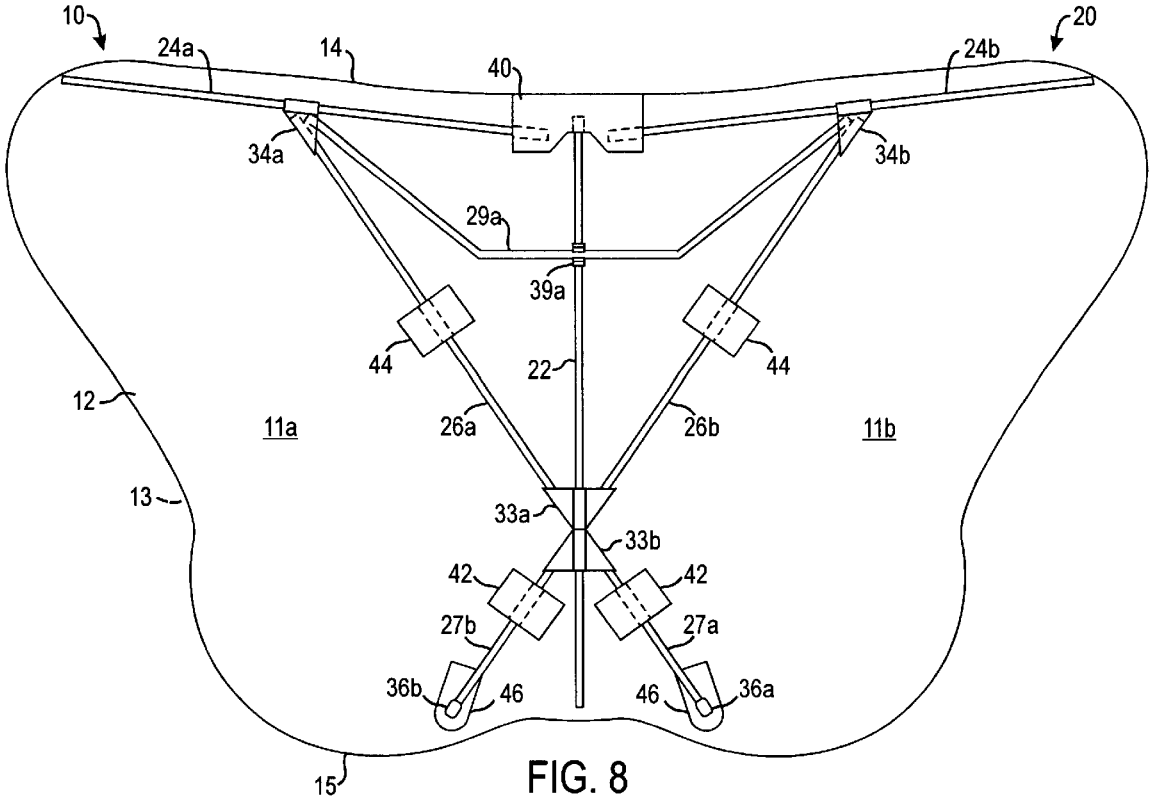
FIG. 8 illustrates a plan view of another embodiment of a kite according to the present invention.

Referring to FIG. 8, another embodiment of the disclosed kite is illustrated in a plan view. For convenience, the same element numerals are used in FIG. 8 to represent substantially similar components with those disclosed in the embodiment of FIGS. 1–2 and 7, and discussion of such similar components is omitted for brevity. In the present embodiment of the disclosed kite, an alternative brace member 29*a* is used with the supporting structure 20. The brace member 29*a* has a plurality of pre-formed straight sections. First and second ends of the brace member 29*a* respectively couple to coupling members at 34*a–b*, and an intermediate portion of the brace member 29*a* is held adjacent the central member 22 by an alternative holding member or clip at 39*a*. During assembly, the straight sections of the member 29*a* are slightly deformed so that the member 29*a* is capable of biasing the wing members 24*a–b* apart. The clip at 39*a* is attached to the central member 22 using techniques disclosed herein and allows the brace member 29*a* to snap fit therein. In addition, the clip at 39*a* can allow the brace member 29*a* to pivot therein.

The first and second cross members 26*a–b* are shorter than those disclosed in connection with FIGS. 1, 2, and 7. The cross members 26*a–b* each have first and second ends. The first ends respectively couple to coupling members at 34*a–b*. The second ends couple to a dual coupling member at 33*a* that is attached to the central member 22 using techniques disclosed herein. The dual coupling member at 33*a* includes two cup portions that are attached on either side of the central member 22 and that respectively receive an end of one of the cross members 26*a–b*.

Additional, short cross members 27*a–b* are provided near the second edge 15 of the body 10. These short cross members 27*a–b* each have first and second ends. The first ends respectively couple to a second dual coupling member at 33*b*, which is attached to the central member 22 using techniques disclosed herein and is similar to that disclosed above. The second ends of the short cross members 27*a–b* respectively couple to the body 10 near the second edge 15 using end members at 36*a–b*. Other components and functions of the disclosed kite are substantially similar to the embodiments disclosed above with reference to FIGS. 1–7.

Figure 9:
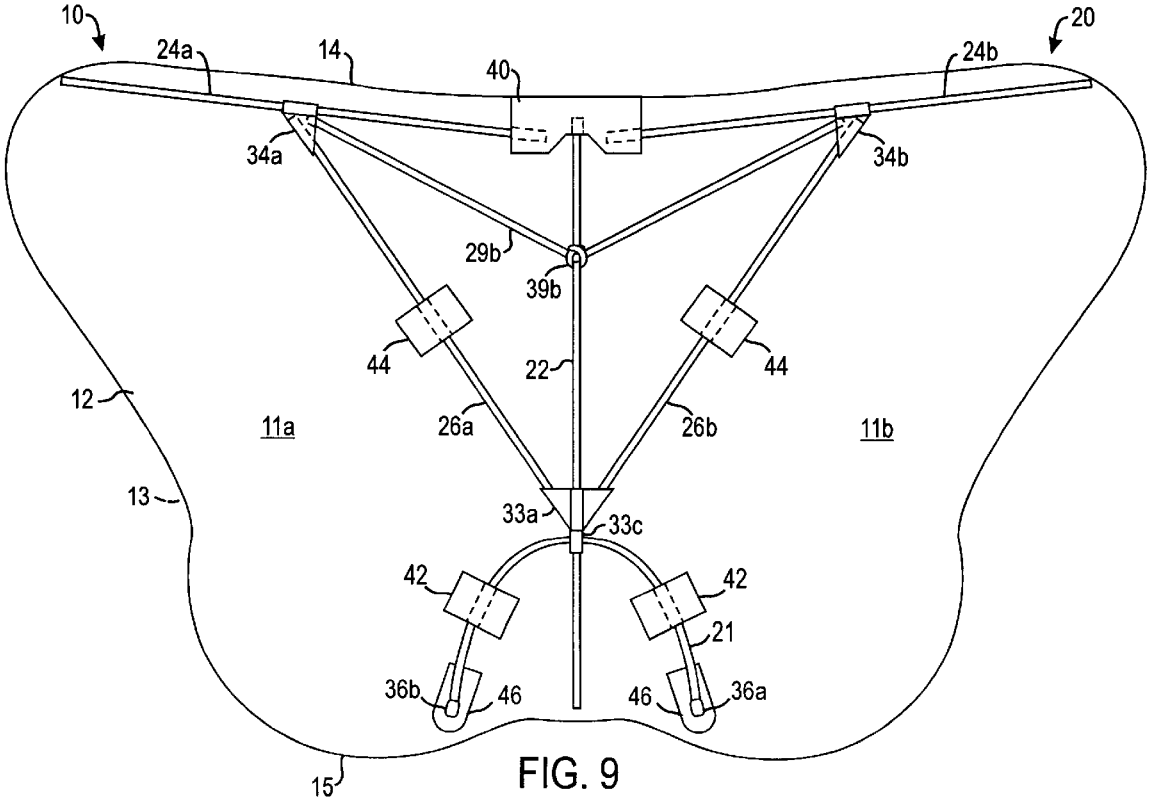
FIG. 9 illustrates a plan view of yet another embodiment of a kite according to the present invention.

Referring to FIG. 9, yet another embodiment of the disclosed kite is illustrated in a plan view. For convenience, the same element numerals are used in FIG. 9 to represent substantially similar components with those disclosed in the embodiment of FIGS. 1–2, 7, and 8, and discussion of these similar components is omitted for brevity. In the present embodiment of the disclosed kite, alternative brace member 29*b* is used with the supporting structure 20. The brace member 29*b* has a "V" shape. First and second ends of the brace member 29*b* respectively couple to the coupling members at 34*a–b*, and an intermediate portion of the member 29*a* is held adjacent the central member 22 by an alternative holding member or tie at 39*b*. During assembly, the brace member 29*b* is slightly deformed so that the member 29*a* is capable of biasing the wing members 24*a–b* apart. The tie at 39*b* is attached to the central member 22 and is tied around the intermediate portion of the brace member 29*b* to hold it adjacent the central member 22. In addition, the tie at 39*b* can allow the brace member 29*b* to pivot therein.

The cross members 26*a–b*, the coupling members 34*a–b*, and the dual coupling member at 33*a* are substantially similar to those disclosed above. In contrast to previous embodiments, an additional supporting member 21 is provided near the second edge 15 of the body 10. The additional supporting member 21 can have an inverted "V" or "U" shape. Preferably, the supporting member 21 is initially a hollow, cylindrical rod that is deformed to form a "U" or horseshoe shape when assembling the disclosed kite. Ends of the supporting member 21 are positioned near the edge 15 of the body 10 and on either side of the central member 22. End members 36*a–b* and reinforcement tabs 42 and 46, such as discussed above, are used to attach the supporting member 21 to the body 10. An intermediate portion of the supporting member 21 is held adjacent the central member 22 by an attachment at 33*c*, which is preferably positioned near the dual coupling member at 33*a*. The attachment at 33*c* preferably fixes the supporting member 21 to the central member 22 to prevent movement relative thereto. Other components and functions of the disclosed kite are substantially similar to the embodiments disclosed above with reference to FIGS. 1–8.

In an alternative embodiment, the supporting member 21 can be preformed to have the horseshoe shape and can be affixed to the body 10 in the position shown in FIG. 9 using techniques similar to those used on the central member 22, thereby eliminating the need for end members 36*a–b*. In addition, the preformed, horseshoe-shaped supporting member 21 can be fixedly connected to or integral with the central member 22 at 33*c*, using techniques disclosed herein or known in the art.

The foregoing description of preferred and alternative embodiments of the disclosed kite and components thereof is not intended to limit or restrict the scope or applicability of the invention that was conceived of by the Applicants. In exchange for disclosing the inventive concepts contained herein, the Applicants desire all patent rights afforded by the appended claims. Therefore, it is intended that the invention include all modifications and alterations to the full extent that they come within the scope of the following claims or the equivalents thereof.

What is claimed is:

1. A kite comprising:

a body;

a central member attached to the body;

a wing member attached to the body on one side of the central member, the wing member being separate from and unattached to the central member;

a cross member having first, second, and third portions, the first portion being held adjacent the wing member, the second portion being held adjacent a first point of the central member, and the third portion being held adjacent the body on another side of the central member, whereby the cross member passes across the central member; and a brace member capable of biasing the wing member from the central member and having first and second portions, the first portion being held adjacent the wing member and the second portion being held adjacent a second point of the central member.

2. The kite of claim 1, wherein the wing member is orientated at a substantially perpendicular angle with respect to the central member.

3. The kite of claim 1, wherein a first distance from the first point to a first end of the central member is approximately one-fourth a length of the central member, and wherein a second distance from the second point to a second end of the central member is approximately one-fourth the length of the central member.

4. The kite of claim 1, wherein the first portion of the cross member is held adjacent the wing member at a substantially equivalent point on the wing member as the first portion of the brace member.

5. The kite of claim 1, comprising a coupling member attached to the wing member for holding the first portions of the cross member and the brace member adjacent thereto.

6. The kite of claim 5, wherein the coupling member comprises a cup portion receiving ends of the first portions of the cross member and the brace member therein.

7. The kite of claim 1, comprising a coupling member attached to the central member for holding the second portion of the cross member adjacent thereto.

8. The kite of claim 7, wherein the coupling member comprises a loop portion through which the second portion of the cross member is capable of passing.

9. The kite of claim 1, comprising a coupling member attached to the central member for holding the second portion of the brace member adjacent thereto.

10. The kite of claim 9, wherein the coupling member comprises a loop portion through which the second portion of the brace member is capable of passing.

11. A kite comprising:

a body;

a central member attached to the body such that the body has a first wing portion on one side of the central member and has a second wing portion on an opposite side of the central member;

a first wing member attached to the first wing portion of the body, the first wing member being separate from and unattached to the central member;

a second wing member attached to the second wing portion of the body, the second wing member being separate from and unattached to the central member;

a first cross member having first, second, and third portions, the first portion being held adjacent the first wing member, the second portion being held adjacent the central member at a first point, and the third portion being held adjacent the second wing portion of the body, whereby the first cross member passes across the central member;

a second cross member having first, second, and third portions, the first portion being held adjacent the second wing member, the second portion being held adjacent the central member at a second point, and the third portion being held adjacent the first wing portion of the body, whereby the second cross member passes across the central member; and a brace member capable of biasing the first and second wing members apart and having first, second, and third portions, the first portion being held adjacent the first wing member, the second portion being held adjacent the central member at a third point, and the third portion being held adjacent the second wing member.

12. The kite of claim 11, wherein the first and second wing members are orientated at substantially perpendicular angles with respect to the central member.

13. The kite of claim 11, wherein the first portion of the first cross member is held adjacent the first wing member at a substantially equivalent point on the first wing member as the first portion of the brace member.

14. The kite of claim 11, wherein the first and second points where the first and second cross members are held adjacent the central member are substantially the same.

15. The kite of claim 11, wherein a first distance from the first point to one end of the central member is approximately one-fourth a length of the central member, and wherein a second distance from the third point to another end of the central member is approximately one-fourth the length of the central member.

16. The kite of claim 1, comprising a coupling member attached to the first wing member for holding the first portions of the first cross member and the brace member adjacent thereto.

17. The kite of claim 16, wherein the coupling member comprises a cup portion receiving ends of the first portions of the first cross member and the brace member therein.

18. The kite of claim 1, comprising a coupling member attached to the central member for holding the second portions of both of the cross members adjacent thereto.

19. The kite of claim 18, wherein the coupling member comprises a loop portion through which the second portions of the cross members are capable of passing.

20. The kite of claim 11, comprising a coupling member attached to the central member for holding the second portion of the brace member adjacent thereto.

21. The kite of claim 20, wherein the coupling member comprises a loop portion through which the second portion of the brace member is capable of passing.

22. A kite comprising:

a body;

a central rod attached to the body such that the body has a first wing portion on one side of the central rod and has a second wing portion on an opposite side of the central rod;

a first coupling member attached to the central rod;

a first wing rod attached to the first wing portion of the body, the first wing rod being separate from and unattached to the central rod;

a second wing rod attached to the second wing portion of the body, the second wing rod being separate from and unattached to the central rod;

a first cross rod having first and second ends and an intermediate portion, the first end attached to the first wing rod, the intermediate portion passing through the first coupling member attached to the central rod, the second end attached to the second wing portion of the body;

a second cross rod having first and second ends and an intermediate portion, the first end attached to the second wing rod, the intermediate portion passing through the first coupling member attached to the central rod, the second end attached to the first wing portion of the body;

a second coupling member attached to the rod; and a brace rod capable of biasing the first and second wing rods apart and having first and second ends and an intermediate portion, the first end attached to the first wing member, the intermediate portion passing through the second coupling member attached to the central rod, the second end attached to the second wing member.

23. The kite of claim 22, wherein the first coupling member attached to the central rod comprises a loop through which the intermediate portions of both cross rods pass.

24. The kite of claim 22, wherein the first ends of the cross rods are each attached to the wing rods by cups attached to the wing rods and receiving the first ends of the cross rods.

25. The kite of claim 24, wherein the first and second ends of the brace rod arc each attached to the wing rods by the same cups.

26. The kite of claim 22, wherein the second ends of the cross rods are each attached to the body by hooks attached to the cross rods and catching in holes defined in the body.

27. The kite of claim 22, wherein the second coupling member attached to the central rod comprises a loop through which the intermediate portion of the brace rod passes.

* * * * *

UNITED STATES PATENT AND TRADEMARK OFFICE

CERTIFICATE OF CORRECTION

PATENT NO. : 6,722,613 B1
DATED : April 20, 2004
INVENTOR(S) : Phillips, et al.

It is certified that error appears in the above-identified patent and that said Letters Patent is hereby corrected as shown below:

Column 10,
Line 64, delete “claim 1” and insert -- claim 11 --.

Column 11,
Line 4, delete “claim 1” and insert -- claim 11 --.

Column 12,
Line 24, delete “arc” and insert -- are --.

Signed and Sealed this

Twentieth Day of July, 2004

JON W. DUDAS
*Acting Director of the United States Patent and Trademark Office*